US005325909A

United States Patent [19]

Unterderweide

[11] Patent Number: 5,325,909

[45] Date of Patent: Jul. 5, 1994

[54] PROCESS FOR HARDENING SAND FOUNDRY PARTS

[76] Inventor: Artur Unterderweide, Hauptstrasse 23, D-3565 Breidenbach, Fed. Rep. of Germany

[21] Appl. No.: 975,943

[22] PCT Filed: Jun. 19, 1992

[86] PCT No.: PCT/DE92/00506

§ 371 Date: Feb. 23, 1993

§ 102(e) Date: Feb. 23, 1993

[87] PCT Pub. No.: WO93/00187

PCT Pub. Date: Jan. 7, 1993

[30] Foreign Application Priority Data

Jun. 25, 1991 [DE] Fed. Rep. of Germany ..... 4120928

[51] Int. Cl.[5] ..... B22C 9/12

[52] U.S. Cl. ..... 164/456; 164/5; 164/12; 164/16

[58] Field of Search ..... 164/16, 12, 5, 159, 164/456

[56] References Cited

U.S. PATENT DOCUMENTS

| | | | |
|---|---|---|---|
| 2,874,428 | 2/1959 | Bonney, Jr. . | |
| 3,919,162 | 11/1975 | Austin | 164/12 X |
| 4,886,105 | 12/1989 | Nisi et al. | 164/16 |
| 5,005,630 | 4/1991 | Gahler | 164/16 |
| 5,135,043 | 8/1992 | Drake | 164/16 X |

FOREIGN PATENT DOCUMENTS

| | | | |
|---|---|---|---|
| 2125153 | 11/1972 | Fed. Rep. of Germany | 164/16 |
| 2457638 | 6/1976 | Fed. Rep. of Germany | 164/16 |
| 2550588 | 7/1976 | Fed. Rep. of Germany | 164/5 |
| 2526875 | 12/1976 | Fed. Rep. of Germany . | |
| 2437894 | 4/1980 | France . | |
| 48-32054 | 10/1973 | Japan | 164/16 |
| 54-10225 | 1/1979 | Japan | 164/16 |
| 1276428 | 12/1986 | U.S.S.R. | 164/16 |

*Primary Examiner*—J. Reed Batten, Jr.
*Attorney, Agent, or Firm*—Dominik, Stein, Saccocio, Reese, Colitz and Van Der Wall

[57] ABSTRACT

A primary gas supply circuit and a secondary gas supply circuit are provided with the primary circuit having a part in common with the secondary circuit. The primary circuit is provided with a source of hardening gas. A sand foundry part containing a binding agent is provided in the part in common with the primary and secondary gas supply circuits. Through the primary gas supply circuit a hardening gas/carrier gas is circulated through the sand foundry part containing the binding agent. The primary gas supply circuit is closed when the quantity of hardening gas present in the part of the primary gas supply circuit common to the secondary gas supply circuit is an amount corresponding to, or slightly exceeding, the theoretical quantity for a complete hardening reaction. The secondary supply circuit is opened and the hardening gas/carrier gas is circulated through the secondary supply circuit until the hardening reaction has been completed.

4 Claims, 1 Drawing Sheet

PROCESS FOR HARDENING SAND FOUNDRY PARTS

FIELD OF THE INVENTION

The invention relates to a process for hardening sand foundry parts especially for foundries, but also for other applications of the technique in which a carrier gas/-hardening gas stream is circuitously led through the sand foundry part several times.

DISCUSSION OF THE RELATED BACKGROUND OF THE INVENTION

These gassing processes have become increasingly important owing to their higher productivity, their lower energy requirement and their improved working conditions. Their principle is that a stream of carrier gas/hardening gas is forced through or sucked through the sand foundry part which is in a mould. The sand foundry part consists of a mixture comprising a basic material (for example quartz sand, zircon sand, chromite sand) and one or more binding agents which can be hardened by the hardening gas. The carrier gas used is mostly air or nitrogen. The hardening gas which can act either in a reactive or in a catalytic manner initiates the hardening of the binding agent in the sand foundry part. The reactive hardening gas is thereby almost depleted whereas the catalytic hardening gas is hardly used. The hardening of the binding agent is finished in an economically useful time period, and the sand foundry part can then be removed from the mould for further use such as for the casting of the molten metal.

In practice various gassing methods are used. The best known methods are the cold box method (phenolic resin/isocyanate binder using vaporous tertiary amines as hardening gas), the $CO_2$-process (water-glass-binder with $CO_2$ as the hardening gas), the $SO_2$-process (polyurethane/peroxide with $SO_2$ as a hardening gas), the beta-set process (phenolic resin with methyl formate as the hardening gas) and the red-set process (resin binder and sulphuric acid with acetals as the hardening gas).

Most of the gassing processes function so that the carrier gas/hardening gas stream is forced or sucked through the sand foundry part in the mould once in every hardening circuit. Examples of this are in DE patent application (Offenlegungschrift) No. 27 47 109 and in DE patent 25 26 875.

The hardening gas thereby is always used in a large excess to ensure that the hardening reaction occurs throughout the sand foundry part. This is true for reactive and for catalytic hardening gases. As a result the unused reactive hardening gas, or most of the added catalytic hardening gas,-as it is unused or substantially unused, can be found in the exhaust gases.

Since, with the exception of $CO_2$, all hardening gases used in the various gassing processes are hazardous to health and the environment and since after the hardening reaction they are present at a concentration which in accordance with the current air pollution requirements can not be released safely into the environment, there is the necessity to remove these pollutants from the exhaust fumes. Numerous processes and installations are known for this purpose which are described, for example in EP patent 128 974, DE patent 40 07 798, DE patent application (Auslegeschrift) 26 20 303, DE patent application (Offenlegungschrift) 37 42 449, DE patent application (Offenlegungschrift) 26 21 153, and in GB patent 12 69 203. All these solutions have the disadvantage that the required equipment is expensive to acquire and maintain, and thus the advantages of the gassing processes described above are either partially counterbalanced or the disposal still remains a problem.

From FR patent 24 37 894 there is known a gassing process in which the hardening gas, a catalyst (in particular an amine), is not only lead once but several times through the sand foundry part which is in contrast to the previously described processes. For this purpose the hardening gas is fed into a circuit which goes through the sand foundry part and within which it is recycled together with the carrier gas (air) until the sand foundry part is hardened. With this process the sand foundry part is hardened throughout with the concomitant lowering of the quantity of catalyst provided.

The disadvantage of this process is that after each hardening cycle, the circuit has to be decreased by the initial cycle volume, since otherwise it would become inflated. The exhaust air which needs to be removed from the cycle has to be purified before it can be emitted into the environment despite the decrease in the amount of catalyst used.

SUMMARY OF THE INVENTION

The object of the present invention is to provide a process for the hardening of sand foundry parts which works without exhaust air and which therefore renders superfluous expensive cleaning methods.

The problem is solved by the present invention, either by using a quantity of hardening gas which corresponds to, or slightly exceeds, the theoretical quantity for a complete hardening reaction, wherein a primary gas supply circuit, which is led over a hardening gas source, is circulated until the said quantity of hardening gas is present in the part of the primary gas supply circuit which at the same time is part of the secondary gas supply circuit, whereupon the primary gas supply circuit is closed, the secondary gas supply circuit is opened, and the latter is circulated until the hardening reaction has been fully completed.

The theoretically necessary quantity of hardening gas for a completion of the hardening reaction can easily be determined from the volume of the sand foundry part and the mixing ratio of sand and binding agent. This quantity for the hardening of the sand foundry part is provided by activating the primary gas supply circuit or continuing to activate the primary gas supply circuit until this quantity is present in that part of the primary circuit common to the secondary circuit. The number of primary gas supply circuits that have to be run thereby depends upon the size of the sand foundry part and on the capacity of the carrier gas stream which is led over the source of the hardening gas. It can in practice be only part of a circuit or up to several circuits.

When the required quantity of hardening gas is present in the common part of both circuits, the primary gas supply circuit is closed and the secondary supply gassing circuit is opened. In this circuit the carrier gas/-hardening gas stream is circulated through the sand foundry part until the hardening reaction is finished, which of course has already started with the gassing of the primary gas supply circuit.

In the case of a reactive hardening gas, this has been completely depleted or depleted to such an extent, that the remaining concentration in the carrier gas is not hazardous to the environment. The hardened sand foundry part can therefore be removed from the mould without the usual scavenging process. Furthermore if a catalytic gas is used for the gassing a scavenging process is not necessary owing to the very low concentration of the hardening gas in the carrier gas of the secondary gas supply circuit, prior to the removal of the hardened sand foundry part.

In the process according to the invention, practically no exhaust gas is produced since inflation of the secondary circuit does not occur because of the interweaving of both the circuits.

Therefore the process according to the present invention is very environmentally friendly without a lowering of the quality of the produced sand foundry part and with concomitant dramatic decrease in the use of the hardening chemicals. It additionally allows the operation of all known gassing processes without disposal problems.

BRIEF DESCRIPTION OF THE DRAWING

The single FIGURE is a schematic representation of the process according to the present invention.

DETAILED DESCRIPTION OF THE INVENTION

Figure 1:
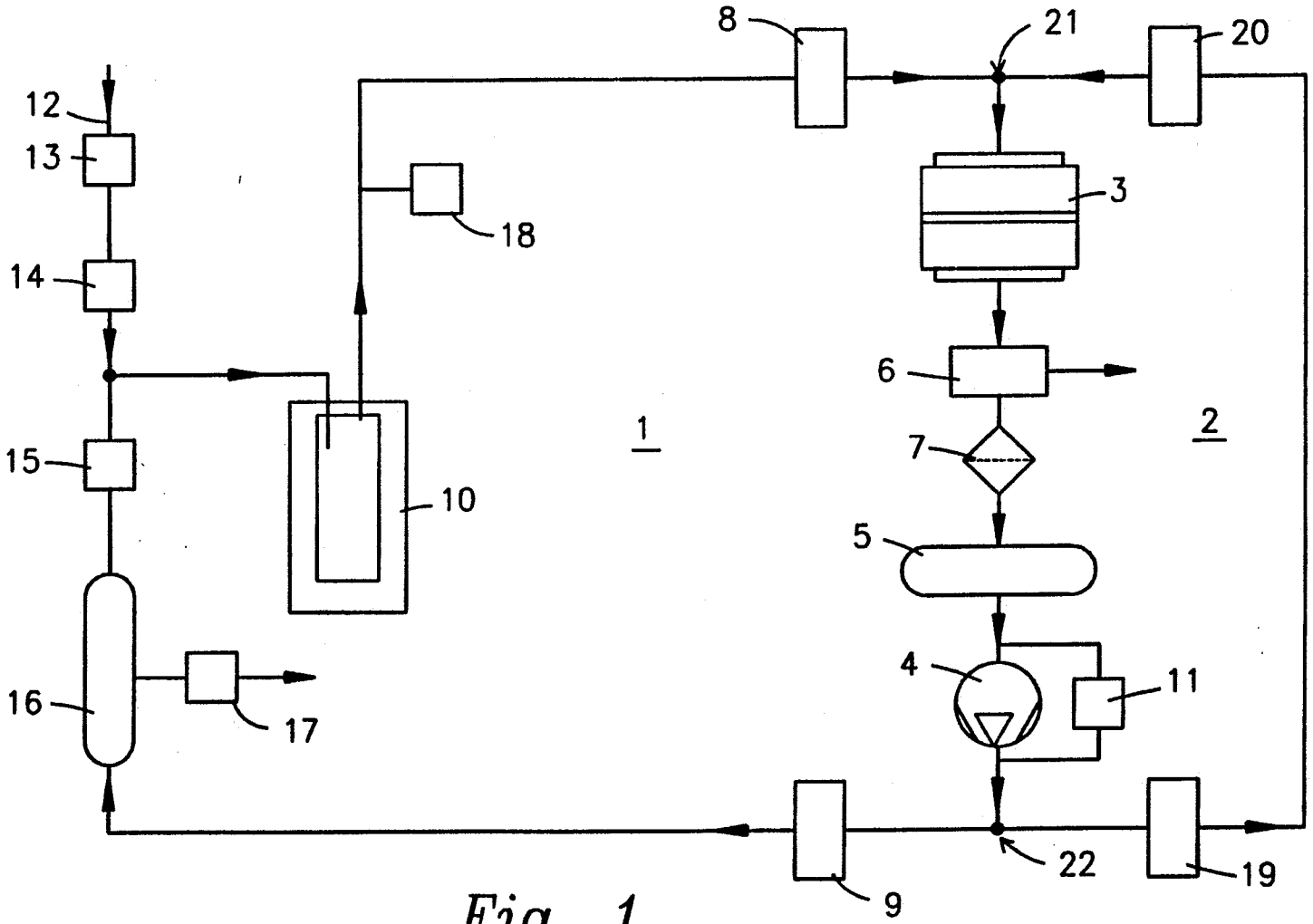

The invention is more precisely illustrated below by means of one embodiment. The drawing relating thereto is the schematic model of the process, in which the primary gas supply circuit is labelled 1 and the secondary gas supply circuit is labelled 2. A mould 3 consisting of upper and lower mould parts, a vacuum store 5, a suction pump 4 and a hardening gas vaporiser 10 essentially belong to the primary gas supply circuit 1. The mould 3, the vacuum store 5 and the suction pump 4 and the connecting pipes relating thereto are at the same time part of the secondary gas supply circuit 2.

The mould 3 corresponds to moulds commonly used in gassing processes and therefore no further explanation is needed. A valve 6 is in series. It is a three way valve. Because of the suitable position of valve 6, air which was displaced from the mould 3 by the shooting of the sand core or the sand form prior to the gassing, can escape via this valve. The subsequent filter 7 is used to protect the suction pump 4 and other parts of the process which may be endangered by sand particles escaping from the mould 3 during the form or core shooting.

The process of the present invention operates according to the schematic circuit shown and as explained below.

When the form- or core shooting is finished, the mould 3 is then ready for the gassing process and the valve 6 is inserted in the flow path of circuits 1 or 2. The valve 9 of the primary gas supply circuit 1 is open, the valves 19, 20 of the secondary gas supply circuit 2 are closed. The suction pump 4 is working and forces the carrier gas stream, air or nitrogen, over the hardening gas vaporiser 10 whereby it is loaded with hardening gas vapour. The loading can be measured by means of a gas chromatograph 18. After the hardening gas vaporiser 10 the carrier gas/hardening gas stream accumulates in front of the dosage valve 8. This is opened at intervals, and the suction pump 4 sucks the carrier gas/-hardening gas stream through the sand foundry part (not illustrated) which is in the mould 3.

The vacuum store 5 supports the suction action of the suction pump 4, which slowly, not immediately, builds up the vacuum as necessary. This vacuum store is particularly needed if large sand foundry parts are to be hardened.

By means of a pressure regulator 11 which can be realized as a bypass to the suction pump 4, the gas pressure is preferably regulated at 0.6 to 0.8 bar. If the necessary gas pressure is below 0.3 bar, pressurised air or nitrogen is fed into the primary supply gas circuit 1 via the supply 12 and the pressure regulator 13. This was not, however, necessary in the trials performed. Return valves 14 and 15 ensure that each of the gas streams flow in the desired direction.

If there is an excess pressure (2.5 bar) a security valve 17 in the store 16 is activated and releases it to a disposal site.

If the quantity of hardening gas needed according to the present invention is present between points 21 and 22 of both the circuits 1 and 2, valves 8 and 9 are closed and valves 19 and 20 are opened. The suction pump 4 continues to work and now pumps the carrier gas/hardening gas stream into the secondary gas supply circuit 2 for the duration needed to conclude the hardening reaction in the sand foundry part. The suction pump 4 is then switched off and the valves 19 and 20 are closed. Without any problems to the environment the hardened sand foundry part can then be removed from the mould 3 which can then be prepared for the next cycle.

In the trials performed the measured maximum concentrations were far below the allowed limits of exhaust pollutants in air, so that there was no need for a disposal or removal by suction.

In trials in accordance with the beta-set-process the use of methyl formate was below 20% (relative to resin) and therefore could be lowered by approximately 60 to 70%.

A further advantage of the process according to the present invention is that leakages which may affect the environment cannot occur because both circuits 1 and 2 are run under vacuum. In the primary gas supply circuit 1 which is led over the hardening gas vaporiser 10 the vacuum process has the additional advantage that the vaporising conditions are more favourable to the hardening component. Favourable gassing conditions are also provided by the pressure difference at the mould 3.

I claim:

1. A process for the hardening of a sand foundry part wherein a hardening gas is circulated through a sand foundry part containing a binding agent to cause hardening of said sand foundry part, the process comprising the steps of:

providing a primary gas supply circuit and a secondary gas supply circuit, said primary gas supply circuit having a part in common with said secondary gas supply circuit, and said primary circuit being provided with a source of hardening gas;

providing a sand foundry part containing a binding agent in said part in common with said primary and secondary gas supply circuits and in communication with any gasses circulating therein;

circulating by means of said primary gas supply circuit a hardening gas/carrier gas through said sand foundry part containing said binding agent;

closing said primary gas supply circuit when the quantity of said hardening gas present in the part of the primary gas supply circuit common to the secondary gas supply circuit is an amount corresponding to, or slightly exceeding, the theoretical quantity for a complete hardening reaction;

opening the secondary gas supply circuit; and circulating the hardening gas/carrier gas through the secondary supply circuit until the hardening of the sand foundry part has been completed.

2. A process as in claim 1, wherein said process is run under vacuum.

3. A process as in claim 1, wherein said hardening gas is a reactive gas.

4. A process as in claim 1, wherein said hardening gas is a catalytic gas.

* * * * *